United States Patent [19]

Zagorski et al.

[11] Patent Number: 4,549,534

[45] Date of Patent: Oct. 29, 1985

[54] LEG EXERCISE DEVICE

[76] Inventors: Joseph B. Zagorski, 440 Castania, Coral Gables, Fla. 33134; Stephen C. Roy, 3010 Saint James Dr., Boca Raton, Fla. 33434

[21] Appl. No.: 457,516

[22] Filed: Jan. 13, 1983

[51] Int. Cl.[4] ..... A61H 1/02

[52] U.S. Cl. ..... 128/25 R; 128/51; 128/75

[58] Field of Search ..... 128/24.2, 24.5, 25 R, 128/48–52, 44; 272/144–145, 142, 134, 900

[56] References Cited

U.S. PATENT DOCUMENTS

| | | | |
|---|---|---|---|
| 2,193,882 | 3/1940 | Peterson | 128/51 X |
| 2,696,206 | 12/1954 | Bierman | 128/51 |
| 2,865,367 | 12/1958 | Sorenson | 128/71 |
| 3,824,993 | 7/1974 | Grant | 128/25 R |
| 3,917,261 | 11/1975 | Small et al. | 128/25 D |
| 4,282,865 | 8/1981 | Pogue | 128/25 |
| 4,323,060 | 4/1982 | Pecheux | 128/75 X |

FOREIGN PATENT DOCUMENTS

| | | | |
|---|---|---|---|
| 2015054 | 10/1971 | Fed. Rep. of Germany | 128/25 |
| 2524468 | 12/1976 | Fed. Rep. of Germany | 272/144 |
| 464444 | 12/1968 | Switzerland | 128/71 |
| 159947 | 1/1964 | U.S.S.R. | 128/25 R |

*Primary Examiner*—Robert A. Hafer
*Assistant Examiner*—Arnold W. Kramer
*Attorney, Agent, or Firm*—Larson and Taylor

[57] ABSTRACT

A continuous passive motion leg exercise device for rehabilitation of knee motion, hip motion, and ankle motion after trauma or surgery is disclosed. The device includes an elongated base, a thigh support, a lower leg support pivotally connected to the thigh support, and a foot support pivotally connected to the lower leg support. The distal end of the lower leg support and foot support are mounted on a sliding bearing attached to the base. The thigh support is pivotally mounted to a thigh brace at one end. At the other end, the thigh brace engages a threaded drive screw extending from an enclosed motor assembly. The threaded drive screw is also enclosed except where the thigh brace extends through the enclosure. Movement of the thigh brace along the drive screw causes the thigh support, lower leg support, and foot support to move in a knee bending motion. The motor includes a motor cycling device which reverses rotation of the threaded screw. Preferably, the thigh support and lower leg support are adjustable and the degree of bending of the knee is also adjustable. In addition, the motor includes an on/off switch located at the distal end, away from the patient, and the speed of the motor is adjustable.

10 Claims, 3 Drawing Figures

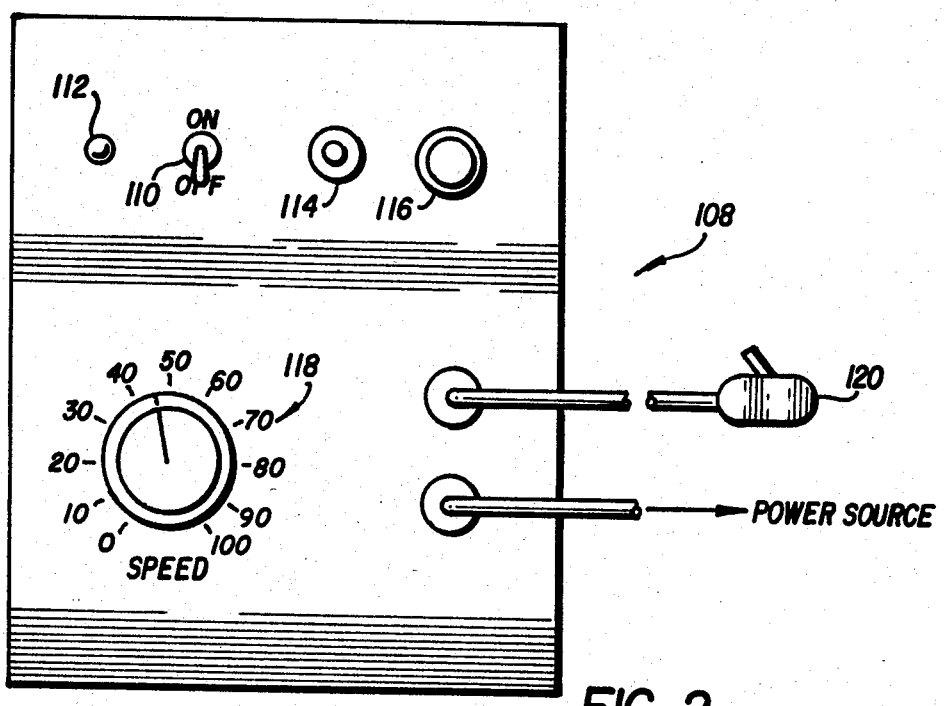
FIG. 2
FIG. 3
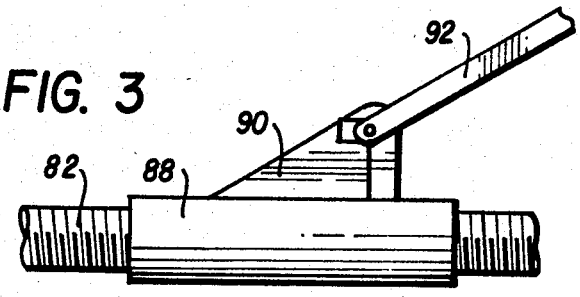

LEG EXERCISE DEVICE

FIELD OF THE INVENTION

The present invention relates generally to rehabilitation devices, and in particular to a rehabilitation device for knee motion, hip motion, or ankle motion after trauma or surgery to the lower extremity.

BACKGROUND OF THE INVENTION

One initial concept of continuous passive motion was pioneered by Dr. Vernon Nickel of San Diego in 1960 and by Dr. Robert Salter of Toronto, who demonstrated significant healing of joint cartilage defects in rabbits when continuous passive motion was applied. Dr. Salter's work, which was published in the December 1980 *Journal of Bone and Joint Surgery,* inspired Dr. Richard Coutts of San Diego to take the concept and apply it to the post operative total need patient. The preliminary results of Dr. Coutts' work were presented at the 1982 Orthopedic Research Society in January of that year and was entitled "The Role of Continuous Passive Motion in the Post-Operative Rehabilitation of the Total Need Patient". A multi-center study currently going on includes nearly every major orthopedic center in the U.S. and this study will be presented at the 1983 AAOS in Anaheim, Calif.

A number of devices have been disclosed in the prior art for the rehabilitation of the lower extremity. In Volume II of *Fractures* by Charles A. Rockwood, Jr., and David P. Green, a traction method for tibial condylar fractures allowing 90 degrees of knee movement is disclosed on page 1,168. The pictured method is patient operated by pulling on a cord with a pivoted leg support of the knee. The pictured device allows traction to be maintained on the leg.

A motorized continuous passive motion knee exercise device has been disclosed by Sutter Biomedical Inc. of San Diego, Calif. This device consists of a support for the lower limb made up of two main segments, a thigh support and a lower leg support. The segments articulate through a joint at the knee level and are adjustable to fit the patient's lower limb. The apparatus has additional joints or linkages at the hip and ankle which can be positioned on the patient's corresponding joint. The heel of the orthosis is mounted on wheels which run on a lower track, keeping the device aligned and providing stability. A DC motor is used as a power source and has variable speed control. The motor is attached to a lever having an adjustment of from three to twelve inches. A rope is connected to the end of the lever and passes through two overhead pulleys and is then attached to the knee joint of the support frame through a snap ring. As the lever is turned by the motor, the rope is alternately shortened and lengthened flexing and exercising the knee. Since the arc of motion is determined by the length of the rotating lever arm, by adjusting the rope length one can vary the range of motion to a maximum of 120 degrees.

Another motorized leg exercising device is manufactured by Cogemo, Paris, France, and is distributed in the United States by Richards Manufacturing Co., Inc. of Memphis, Tenn. The device includes a base, thigh support, lower leg support, and foot support. The lower leg support is pivotally attached to the thigh support and is mounted on rollers which engage the base. A gear motor assembly is located below the thigh and lower leg supports and is controlled by a remote panel and a patient controlled switch.

While the leg exercise devices disclosed in the prior art have proven useful in the rehabilitation of the lower extremities, these devices suffer from a number of disadvantages. The Sutter device is unduly cumbersome and difficult to set up. While the Cogemo device is relatively self contained and easy to set up, when used on a bed the sheets or coverings are prone to jamming the device.

SUMMARY OF THE INVENTION

In accordance with the present invention, a continuous passive motion leg exercise device is disclosed. The exercise device includes an elongate flat base having a proximal end and a distal end and being disposed in a horizontal plane. A thigh support which engages the thigh of the user has a proximal end pivotally attached to the proximal end of the base and a distal end extending above the base. A lower leg support which engages the lower leg has a proximal end pivotally attached to the distal end of the thigh support and a distal end located slightly above the base. A foot support which engages the foot of the user is pivotally attached at the distal end of the lower leg support and is lockable against rotation in a desired orientation. A pair of sliding bearings located on either side of the base support the distal end of the lower leg support to provide a smooth sliding movement when the device is actuated. A thigh brace is pivotally attached at the proximal end to the thigh support and extends below the lower leg support where the thigh brace is attached to a threaded drive nut. The threaded drive nut is mounted on a threaded drive screw which extends from an enclosed motor attached to the distal end of the base. The threaded drive screw is enclosed except for where the thigh brace extends therethrough. The thigh brace is pivotally attached to the drive nut and the thigh support so that rotation of the threaded drive screw causes the angle formed between the thigh support and the lower leg support to vary. A motor cycling means for reversing the rotation of the threaded screw when the angle between the thigh support and the lower leg support reaches a predetermined minimum and maximum is also provided.

In a preferred embodiment of the present invention, the length of the thigh support and the length of the lower leg support are adjustable to accommodate different users. Conveniently, this adjustment is provided by two longitudinal channel members located on either lateral side of the thigh support and lower leg support in which respective bars are received and locked against sliding movement. Preferably, the sliding bearings are cylindrically shaped bearing members mounted on suitably disposed bearing rods.

In order to prevent tampering by the patient, a motor control means including an on/off switch is located at the distal end of the enclosed motor, away from the patient. The motor control means also preferably includes an adjustable control to control the speed of the motor. In order to provide patient control, a remote off/on switch which overrides the on/off switch of the motor control means is also provided adjacent the patient.

In order to reverse the cycle of movement of the leg exercise device, a switch bar extending parallel to the drive screw and having one end engaging a reversing switch of the motor inside of the motor housing is provided. The switch bar is mounted for movement back and forth and a trip bar attached to the drive nut and extending to a position adjacent the switch bar is utilized to control this back and forth movement. A pair of movable stop means are adjustably positionable on the switch bar on either side of the trip bar and are engaged by the trip bar to move the switch bar accordingly. The placement of the adjustable stops determines the bending angle through which the thigh support and lower leg support move.

It is a feature of the present invention that a self-contained kinetic knee exerciser which can be used for either the right or left lower extremity without any adjustments is provided.

It is an advantage of the present invention that the motor and drive screw are located in enclosures and a sliding bearing is used to mount the lower leg support for movement so that the risk of entanglement of the sheets or the like in the exercise device and subsequent malfunction is significantly reduced.

It is a further advantage of the present invention that the location of the motor at the distal end of the base and the location of the lower leg support slightly above this motor allows for almost full extension of the hip at the lowest position.

Still a further advantage of the present invention is that the lifting motion is directed at the thigh support so that the thigh is raised causing flexion at the knee and hip. In this manner, the knee or ankle joint is not subject to the pushing force.

Other features and advantages of the present invention are stated in or are apparent from a detailed description of a presently preferred embodiment of the invention found hereinbelow.

BRIEF DESCRIPTION OF THE DRAWINGS

FIG. 2 is an elevation view of the motor control for the present invention.

FIG. 3 is an enlarged view of the drive nut portion of the invention depicted in FIG. 1.

DETAILED DESCRIPTION OF THE PREFFERED EMBODIMENT

Figure 1:
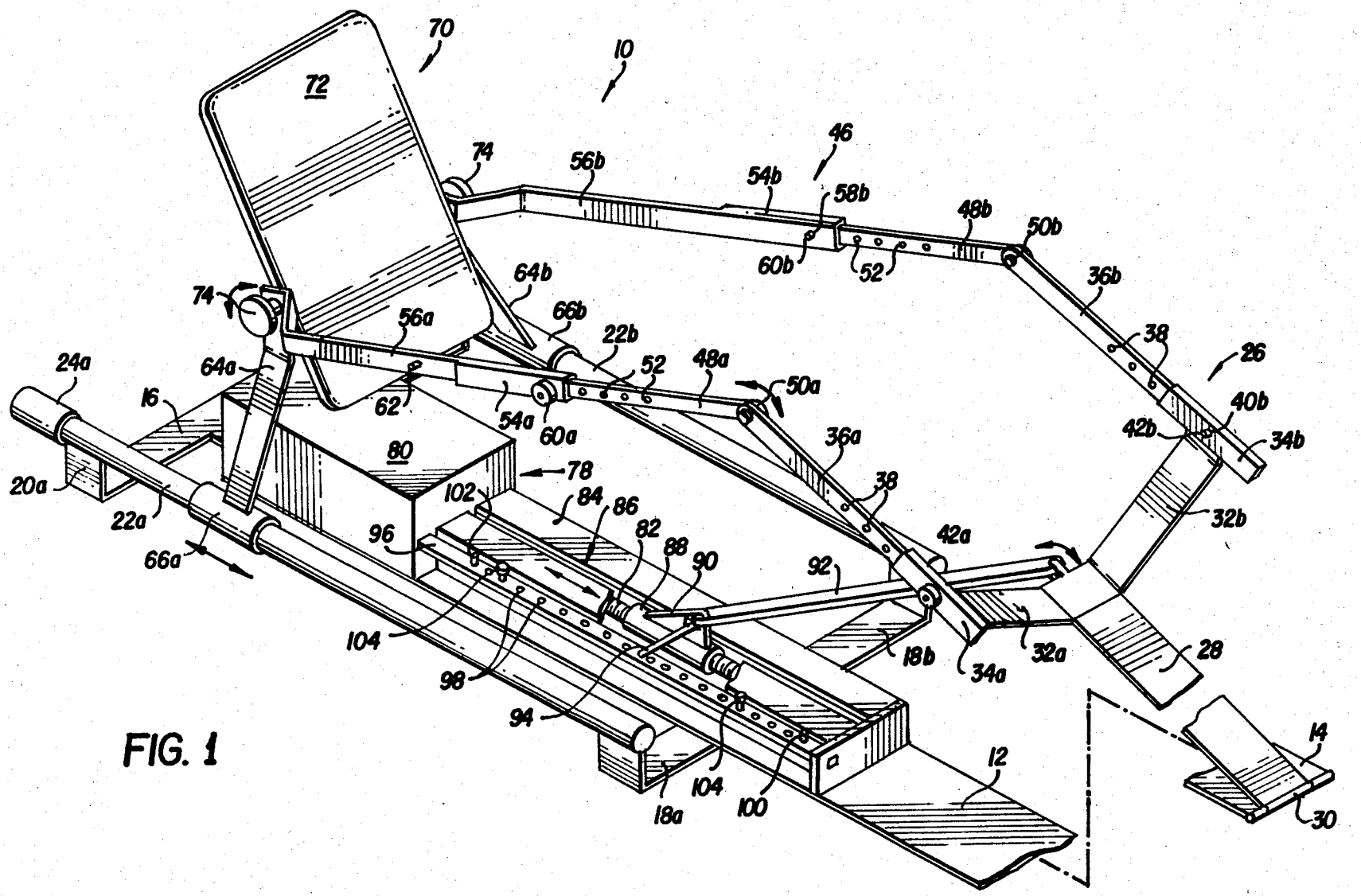
FIG. 1 is a perspective view of a leg exercise device according to the present invention.

With reference now to the drawings in which like numerals represent like elements throughout the several views, a presently preferred embodiment of a leg exercise device 10 is shown which is self contained and easily positionable on a bed or adjacent a wheel chair for use by a patient. Leg exercise device 10 includes a base 12 having a proximal end 14 and a distal end 16. Base 12 is a generally a flat elongate member having lateral upturned extensions 18*a* and 18*b* toward proximal end 14 and lateral upturned extensions 20*a* and 20*b* adjacent distal end 16. Mounted at the upper ends of extensions 18*a* and 20*a* and 18*b* and 20*b* are, respectively, stainless steel rods 22*a* and 22*b*. Rods 22*a* and 22*b* have enlarged distal ends 24*a* and 24*b*, respectively.

Located at proximal end 14 of base 12 is a thigh support means 26. Thigh support means 26 includes a thigh member 28 which is pivotally attached at hinge 30 to proximal end 14. At the other end, thigh member 28 has two upward and laterally extending supports 32*a* and 32*b*. Mounted on the upper ends of supports 32*a* and 32*b* are channel members 34*a* and 34*b*, respectively. Thigh bars 36*a* and 36*b* are received in channel members 34*a* and 34*b*, respectively. Thigh bars 36*a* and 36*b* have a series of apertures 38 therein. Channel members 34*a* and 34*b* also have a single aperture 40*a* and 40*b* respectively, in which a suitable locking bolt 42*a* and 42*b*, respectively, is received. Locking bolt 42 passes through aperture 40 and one of apertures 38 in thigh bar 36 to lock thigh bar 36 in channel member 34.

Located adjacent to thigh support means 26 is lower leg support means 46. Lower leg support means 46 includes lower leg bars 48*a* and 48*b* which are pivotally attached at joints 50*a* and 50*b*, respectively, to thigh bars 36*a* and 36*b*, respectively. Lower leg bars 48*a* and 48*b* have a series of apertures 52 therein as shown. The distal ends of lower leg bars 48*a* and 48*b* are received in channel member 54*a* and 54*b*, respectively. Channel members 54*a* and 54*b* are integrally formed from lower leg members 56*a* and 56*b*, respectively, which are inwardly directed as shown. Channel members 54*a* and 54*b* include an aperture 58 therethrough in which a suitable locking bolt 60*a* and 60*b*, respectively, is received. Locking bolt 60*a* and 60*b* pass through an aperture 52 and respective lower leg bars 48*a* and 48*b* to lock lower leg bars 48*a* and 48*b* in respective channel members 54*a* and 54*b*. Projecting out from lower leg member 56*a* and 56*b* away from channel members 54*a* and 54*b* is a stop 62.

Pivotally mounted at the distal ends of lower leg members 56*a* and 56*b* are bearing braces 64*a* and 64*b*, respectively. The lower ends of bearing braces 64*a* and 64*b* are attached to bearing members 66*a* and 66*b*, respectively. Bearing member 66*a* and 66*b* are generally cylindrically shaped and extend approximately 270 degrees around respective bearing rods 22*a* and 22*b*. respectively. Bearing members 66*a* and 66*b* freely slide along bearing rods 22*a* and 22*b* without interference with lateral upturned extensions 18 and 20 due to the 90 degree open portion.

Located between the distal ends of lower leg members 56*a* and 56*b* is a foot support means 70. Foot support means 70 includes a foot plate 72 which is pivotable about an axle (not shown). The axle extends through the ends of lower leg members 56 and the ends of the axle are threaded. Thus, by screwing handle 74 inward toward foot plate 72, foot plate 72 can be locked in any angular orientation desired relative to lower leg member 56. It should be noted that even when foot plate 72 is locked in place, bearing braces 64, through which the axle also passes, remain freely pivotable on the axle and relative to lower leg members 56. This can be provided by an enlarged shoulder on the axle, or by suitable bearings at the ends of bearing braces 64.

Mounted adjacent distal end 16 of base 12 is a motor means 78. Motor means 78 includes a motor (not shown) located inside of a motor enclosure 80. The motor is a durable 1/5 horse power continuous-rated unit such as manufactured by Bodine Electric Company. The motor is preferably shunt-wound and has adjustable speed and is reversible. The motor is used to drive a threaded drive screw 82 which extends along base 12 toward proximal end 14. As shown, drive screw 82 is completely enclosed in a drive enclosure 84 except for a longitudinal slot 86 therein. It should be noted that motor means 78 is securely attached to base 12 and is chosen to extend only slightly above base 12.

As is additionally shown in FIG. 3, motor means 78 includes a threaded drive nut 88 received on drive screw 82. Extending upwards from drive nut 88 through slot 86 of drive enclosure 84 is an extension 90. Pivotally attached to extension 90 is a thigh brace 92 whose proximal end is similarly pivotally attached to thigh member 28. Extending laterally from extension 90 is a trip bar 94. Trip bar 94 extends adjacent to, but above, a switch bar 96.

As shown best in FIG. 1, switch bar 96 extends parallel to threaded drive screw 82. Switch bar 96 is slidably mounted at the proximal end of drive enclosure 84 and in the proximal end of motor enclosure 80. Switch bar 96 extends into motor enclosure 80 and is attached to a motor reversing switch located inside of motor enclosure 80. Located along the length of switch bar 96 is a series of apertures 98. Upstanding from switch bar 96 is a proximal stop 100 and a distal stop 102. Also depicted extending upwards from switch bar 96 are adjustable locking bolts 104 which are located in apertures 98. Both locking bolts 104 and stops 102 and 100 extend sufficiently above switch bar 96 to be engaged by trip bar 94 as trip bar 94 moves longitudinally along and adjacent to switch bar 96.

Depicted in FIG. 2 is the control panel 108 for motor means 78. Control panel 108 is located on the distal face of motor enclosure 80 so as to be out of the patient's reach. Control panel 108 includes an off/on switch 110 which controls the power to the motor. When off/on switch is in the on position, a light 112 is energized. Control panel 108 also includes a circuit breaker 114 and a fuse 116. The speed of the motor is also adjustable by a speed control knob 118 as shown. In order to provide a patient control of leg exercise device 10, a hand control 120 containing an off/on override switch is provided. Hand control 120 can turn the motor off when off/on switch 110 is in the on position. However, hand control 120 cannot turn the motor on when off/on switch is in the off position. A suitable control panel can be adapted from a panel manufactured Bodine Electric Company.

In operation, leg exercise device 10 functions in the following manner. Initially, leg exercise 10 is in the position where lower leg bars 48 and thigh bars 36 form a straight line. In this position, foot plate 72 is located adjacent distal end 16 of base 12 above motor enclosure 80. In addition, drive nut 88 is adjacent to the distal end of drive screw 82 where trip bar 94 touches stop 102. Locking bolts 104 are removed from apertures 98 and can conveniently be stored in apertures suitably provided in stops 100 and 102. It should also be appreciated that foot plate 72 is covered with an acrylic sheepskin pad (not shown) or sleeve, that a suitable acrylic sling (not shown) extends from lower leg member **56*a* and from lower leg bar 48*a* to lower leg member 56*b* and lower leg bar 48*b*, and that a similar acrylic sling (not shown) extends from thigh bar 36*a* and from channel member 34*a* to thigh bar 36*b* and channel member 34*b*. Conveniently, the acrylic slings can be attached using Velcro straps located underneath of the acrylic sheepskin covering and apertures in the sling provided at the locations of locking bolts 42*a*, 42*b*, 60*a* and 60*b***.

With lower leg device in the initial position, the leg of the patient which is to be exercised is located on leg exercise device 10 and thigh bars 36 and lower leg bars 48 adjusted to located joints **50*a* and 50*b* at the lateral axis of the knee of the patient while the foot of the patient rests on foot plate 72. As this position is achieved, locking bolts 42 and 60 are inserted through respective channel members 34 and 54 to lock thigh bars 36 and lower leg bars 48 in place. It should be noted that stops 62 prevent lower leg bars 48 from passing through channel members 54 to a position where joints 50 are located in channel members 54. In this initial position, the hip flexion is approximately 10 degrees and the knee flexion is approximately 0 degrees for a prone patient. When leg exercise device 10 is designed for use in a hospital bed, a suitable clamp can be provided to secure base 12 to the bed bar. It is also possible to use leg exercise device 10 for a wheel chair patient by positioning leg exercise device 10** on a suitable table or support cart.

Once the tibial adjustment and femoral adjustment of the patient have been made, the physician determines the amount of knee or hip flexion which is desired. Leg exercise device 10 is then adjusted for this by positioning stops 104 at the suitable apertures 98 which have been precalibrated for this purpose. Obviously, trip bar 94 must be located between stops 100 and 102 and between locking bolts 104 (if used). Thus, where the minimum knee flexion is greater than 0 degrees, and distal locking bolt 104 is used, leg exercise device 10 must be actuated to move trip bar 94 to the right of the location of distal locking bolt 104.

When the degree of knee flexion is chosen, such as that knee flexion which would result from the position of locking bolts 104 depicted in FIG. 1, the physician then determines at which speed leg exercise device 10 should operate. This is determined by adjusting speed control knob 118 which is also suitable calibrated. Once this is done, off/on switch 110 is moved to the on position and leg exercise device 10 is ready to be actuated. If desired, hand control 120 is positioned where the patient can actuate the on/off switch to actually actuate leg exercise device 10 as the patient desires. If the patient is unconscious or the physician does not wish for the patient to control the actuation of the leg exercise device 10, the hand switch is merely stowed at distal end 16 and the physician moves hand control 120 to the on position to actuate leg exercise device 10.

The cycle of operation of leg exercise device 10 after actuation is as follows. Initially, assume trip bar 94 is adjacent distal locking bolt 104 so that leg exercise device 10 is at the minimum knee flexion position chosen by the location of distal locking bolt 104 (on the side distant from stop 102). As leg exercise device 10 is actuated, the motor turns threaded drive screw 82 causing drive nut 88 to advance along drive screw 82 toward proximal end 14 of base 12. As this occurs, thigh brace 92 which is against thigh member 28, causes thigh member 28 to be raised and to pull lower leg support means 46 and foot support means 70 along bearing rods 22. As this occurs, knee flexion and hip flexion increases. As drive nut 88 continues to move along drive screw 82, trip bar 94 comes in contact with proximal locking bolt 104 (on the side opposite stop 100). When this occurs, switch bar 96 is moved parallel to drive screw 82 actuating the motor reverse switch located inside of motor enclosure 80 and attached to the distal end of switch bar 96. This causes the rotation of drive screw 82 to reverse and drive nut 88 to travel back toward stop 102 to distal locking bolt 104 where the knee flexion of leg exercise device 10 is again at the minimum. Then, as trip bar 94 contacts distal locking bolt 104, the rotation of drive screw 82 is again reversed to the original rotation and the cycle is repeated indefinitely until off/on switch 110 or the off/on switch in hand control 120 is moved to the off position.

With the design of the present invention, it is possible to provide hip flexion ranges of 10 to 120 degrees. In addition, the range of knee flexion is 0 to 115 degrees.

These large ranges are provided by the low mounting and position of the motor and drive screw, and the low position of bearing rods 22.

The period for one cycle of operation of leg exercise device 10 is preferably adjustable from a three minute period between stops 100 and 102 to a forty second period between stops 100 and 102. Obviously, other adjustment ranges may be provided or desired.

It should be noted that the actuating force for knee flexion is applied at thigh member 28. Therefore, if it is disadvantageous to the patient to apply any force on the foot, the foot of the patient should be spaced somewhat away from foot plate 72.

It should be noted that foot plate 72 can be locked in position where it is desired to maintain a specified angle between the sole of the foot and the lower leg. However, by loosening handle 74, it is possible to allow free ankle motion. In either mode of operation, hip and knee flexion is not affected.

It should be appreciated that leg exercise device 10 is self contained in a relatively sealed mechanism which is not subject to malfunction. In particular, by use of motor enclosure 80 and drive enclosure 84, there is little danger of patient or other objects such as sheets entangling with these devices. In addition, the use of linear bearing members 66 also precludes entanglement of the patient or sheets. It should also be noted that the movement of switch bar 96 necessary to actuate the reversing switch of the motor is relatively small, on the order of ⅛ inch so that entanglement of the switching mechanism is also precluded. The use of linear bearings 66 on rods 22 also provide stability of operation of the device.

It should also be appreciated that the design of the present invention causes the rate of knee flexion to decrease as knee flexion increases. In other words, the rate of increase of knee flexion is greatest when trip bar 94 is located adjacent distal stop 102, and is slowest where trip bar 94 is adjacent proximal stop 100. This affect is achieved through the use of thigh brace 92 which is moved at an angle to thigh member 28.

Although the present invention has been described with respect to an exemplary embodiment thereof, it will be appreciated by those of ordinary skill in the art that variations and modifications can be affected within the scope and spirit of the invention.

We claim:

1. A continuous passive motion exercise device for the lower extremity of a user comprising:

an elongated flat base having a proximal end and a distal end, said base being disposed in a horizontal plane and having a longitudinal axis and a lateral axis;

a thigh support means for engaging the thigh of the user having a proximal end pivotably mounted to the proximal end of said base about a pivot axis parallel to the lateral axis, said thigh support means including two thigh bars located on respective lateral sides of the longitudinal axis of said base having proximal ends and distal ends and a thigh adjusting means for adjusting the distance between the distal ends of said thigh bars and the proximal end of said thigh support means;

a lower leg support means for engaging the lower leg of the user having two lower leg braces located on respective lateral sides of the longitudinal axis of said base having proximal ends and distal ends, said proximal ends of said lower leg braces being pivotably attached to the distal ends of respective said thigh bars about a pivot axis adjacent the knee of the user and said distal ends of said lower leg braces being located above said base, said lower leg support means also including a lower leg adjusting means for adjusting the lengths of said lower leg braces;

a sliding bearing means located slightly above said base for providing a smooth sliding support along an axis parallel to the longtudinal axis of said base for said distal ends of said lower leg braces, said sliding bearing means including two longitudinal bearing rods having a circular cross section and located slightly above respective lateral sides of said base, two cylindrical bearing members slidingly mounted on respective ones of said bearing rods, and two mounting braces attached to respective said cylindrical bearings at one end and extending upwardly therefrom;

a lower leg pivot means for pivotally mounting said distal ends of said lower leg braces relative to the other ends of said mounting braces about a pivot axis parallel to the lateral axis and located adjacent the foot of the user;

a thigh brace having a proximal end which is pivotally attached to said thigh support means and whose distal end extends below said lower leg support means;

an enclosed motor means immovably attached adjacent to the distal end of said base for moving a motor member longitudinally of said base, said motor member including a motor pivot means for pivotally attaching the distal end of said thigh brace to said motor member about a pivot axis parallel to the lateral axis whereby actuation of said motor means causes the angle formed between said thigh support means and said lower leg support means to vary;

a motor cycling means for reversing the longitudinal movement of said motor member when the angle between said thigh support means and said lower leg support means reaches a predetermined minimum and maximum; and an motor adjustment means for ajustably controlling the motor cycling means so as to adjust the minimum and maximum angles.

2. An exercise device as claimed in claim 1 wherein said thigh adjusting means includes two longitudinal channel members attached to said thigh support means and located on respective lateral sides of the longitudinal axis of said base said proximal ends of respective said elongated thigh bars being slidably received in respective said channel members, and a lock means for locking respective said thigh bars against sliding movement in respective said channel members; and wherein said lower leg adjusting means includes two longitudinal channel members located on respective lateral sides of the longitudinal axis of said base, two elongated lower leg bars whose distal ends are slidably received in said respective channel members and whose proximal ends are pivotally attached to respective distal ends of said thigh bars, and a lock means for locking respective said lower leg bars against sliding movement in respective said channel members.

3. An exercise device as claimed in claim 1 and further including a motor control means which includes an off/on switch located at the distal end of said enclosed motor.

4. An exercise device as claimed in claim 3 wherein said motor is an adjustable speed motor and said motor control means further includes an adjuster for motor speed.

5. An exercise device as claimed in claim 4 and further including a remote off/on switch which overrides the off/on switch of said motor control means.

6. An exercise device as claimed in claim 5 wherein said motor means includes a threaded drive screw extending parallel to the longitudinal axis just above said base, an enclosure for said threaded drive screw having a longitudinal slot therein; and wherein said motor member is a threaded drive nut mounted on said threaded drive screw.

7. An exercise device as claimed in claim 6 wherein said adjustment means for adjustably controlling said cycling means includes a switch bar extending parallel to said drive screw and having one end engaging a reversing switch of said motor inside of the motor enclosure, mounting means for mounting said switch bar for longitudinal back and forth motion so that the reverse switch is actuated thereby, a trip bar attached to said drive nut and extending to a position adjacent said switch bar, and a pair of movable stop means which are adjustably positionable along said switch bar on either side of said trip bar for engaging said trip bar as said drive nut and said trip bar move along said drive screw whereby when said trip bar engages said stop means said switch bar is moved causing the reversing switch to reverse the direction of travel of said drive nut and said trip bar.

8. An exercise device as claimed in claim 1 wherein said proximal end of said thigh support means has the pivot axis to said base in the horizontal plane of said base and includes an elongate rigid thigh engaging member extending from the pivot axis of the base upwards along the rear portion of the thigh of the user so as to always positively engage the thigh during movement.

9. An exercise device as claimed in claim 1 wherein said lower leg pivot means includes a foot support means for engaging the foot of the user, a mounting means for mounting said foot support means pivotally about the pivot axis of said lower leg pivot means, and a lock means for locking said foot support means against rotation relative to said lower leg braces.

10. An exercise device as claimed in claim 9 wherein said proximal end of said thigh support means has the pivot axis to said base in the horizontal plane of said base and includes an elongate rigid thigh engaging member extending from the pivot axis of the base upwards along the rear portion of the thigh of the user so as to always positively engage the thigh during movement.

* * * * *